United States Patent [19]

Cheng

[11] Patent Number: 4,751,830

[45] Date of Patent: Jun. 21, 1988

[54] PUSH-BUTTON PADLOCK WITH SECONDARY KEY

[75] Inventor: Ching-Hsiung Cheng, Tinan, Taiwan

[73] Assignee: Lock-R-Lock, Inc., Salinas, Calif.

[21] Appl. No.: 22,399

[22] Filed: Mar. 6, 1987

[30] Foreign Application Priority Data

Mar. 19, 1986 [TW] Taiwan ..... 7122463-3

[51] Int. Cl.[4] ..... E05B 37/14

[52] U.S. Cl. ..... 70/25; 70/285; 70/298

[58] Field of Search ..... 70/285, 284, 21, 25, 70/297, 298

[56] References Cited

U.S. PATENT DOCUMENTS

| | | | |
|---|---|---|---|
| 972,171 | 10/1910 | Dupont | 70/285 |
| 4,476,698 | 10/1984 | Treslo | 70/25 |
| 4,660,394 | 4/1987 | We | 70/298 |

*Primary Examiner*—Robert L. Wolfe

*Attorney, Agent, or Firm*—Jacques M. Dulin

[57] ABSTRACT

The application discloses a push-button lock to which a secondary key is added to the locking system for use when the button combination for a lock is forgotten or not readily available. Unlocking with the secondary key is accomplished by the use of a toothed trigger plate and a gear system. The secondary key turns the gear which in turn rotates the trigger plate. A secondary locking pin secured to the trigger plate rotates with the movement of the trigger plate and releases the shackle. When unlocked by the push-button combination, the shackle is released and the trigger plate is separated from the gear. The toothed end of the trigger plate again aligns with the gear when returned to the locked position. In the preferred embodiment alternative, an elongated flange member having a slot in which a pin on the trigger plate travels is employed in place of the system.

20 Claims, 3 Drawing Sheets

PUSH-BUTTON PADLOCK WITH SECONDARY KEY

FIELD

The invention relates to a push-button lock to which a secondary key is added to the locking system for use when the button combination for a lock is forgotten or not readily available. Unlocking with the secondary key is accomplished by the use of a toothed trigger plate and a gear system. The secondary key turns the gear which in turn rotates the trigger plate. A secondary locking pin secured to the trigger plate rotates with the movement of the trigger plate and releases the shackle. When unlocked by the push-button combination, the shackle is released and the trigger plate is separated from the gear. The toothed end of the trigger plate again aligns with the gear when returned to the locked position. In the preferred embodiment alternative, an elongated flange member having a slot in which a pin on the trigger plate travels is employed in place of the gear system.

BACKGROUND

One serious problem with rotary dial padlocks is that they cannot be used in the dark or by handicapped people. Indeed, even dexterous, fully-sighted persons have difficulty with rotary dial locks. Further, rotary dial operation is slow and the settings are not positive, that is, they are imprecise and do not stay put.

Push-button locks offer the relative pick-resistance of rotary dial locks in that they are combination locks, and also can be opened in the dark or by sightless or physically handicapped persons. They also have positive action.

However, prior push-button locks of the 10-button type do not offer a sufficient number of combinations for institutional use. Further, prior push-button locks are as difficult to open as the rotary dial locks when the combination is lost or forgotten. Normally these locks are destroyed or rendered useless in the process of opening.

In addition, in institutional settings such as schools, there is dual authorization requirement. The school in effect rents locker space to students and provides a school-owned lock. The school retains authority to open the lock at all times. That authority supercedes the student's right and usage of the locker. For example, the school may need to open the lock for the student who forgets or looses his/her combination, who fails to clean out his/her locker at the end of the term or when leaving school during the term, or the school may have a need to inspect the locker for unauthorized articles or contraband.

It is very inconvenient for a school to have to keep handy all the locker lock combinations, because ease of access to combination lists means there is no security for combination information. Further, it is very tedious when at a given time all the lockers must be opened, e.g. at semester end. Consulting combination lists, matching serial numbers to individual locks, and opening hundreds or thousands of locks in a short time is burdensome to the point of near impossibility.

Accordingly, there is a clear need in the art for a lock that has positive action, has the security of a combination, is easier to use than a rotary type, is cheap, can be used in the dark or by sightless or handicapped persons, and has a bypass opening system for persons having overriding authority.

This invention solves those problems by providing a 15-button push-button lock having a secondary keyed unlocking system, which secondary lock can have a common cylinder keyed all the same for institutional use so that one unique master key can open all the locks in the school, regardless of serial number or combination. The addition of the secondary key prolongs the service life of the locks.

THE INVENTION

Objects

It is among the objects of this invention to provide a positive-action combination type lock with a by-pass secondary keying system.

It is another object to provide a push-button lock with enough unique combinational possibilities that duplicate combinations are avoided.

It is another object to provide a combination lock which can be opened in the dark, or by sightless or physically handicapped persons.

It is another object to provide a 15 push-button lock with a secondary locking system that can be keyed alike for large numbers of locks for institutional use.

Still other objects will be evident from the specification and drawings.

Summary

The invention comprises a 15 push-button lock having an upwardly and downwardly reciprocable U-shaped channel member, called a shackle base, on which there is an array of 15 laterally projecting tabs which serve as stops. Only when notches in the buttons are properly vertically aligned with the stop tabs will the shackle base channel member move. Typically 1 to 5 of the 15 buttons are provided with upper notches while the rest of the buttons have notches located lower on the button shaft. The lock combination depends on the location of the special upper slot buttons in the array of the 15 buttons as assembled. Only when the upper slot buttons are depressed do the slots line up with the location of the stop tabs, permitting the shackle base channel to move.

Attached to the shackle base channel is a shackle block having a hole for removably securing a standard U-shaped hardened shackle. When the shackle base channel slides upwardly, the shackle does also, and the lock is opened. This comprises opening the lock in the normal manner by the user upon pressing the correct combination of push-buttons.

The invention further comprises adding a separate key tumbler assembly, which through its rotation, turns a trigger plate on the shackle block. The trigger plate in turn rotates a secondary locking pin to which the trigger plate is secured. The pin shaft has a relieved portion which mates with a semi-circular groove in the shackle. When the locking pin is rotated, the shackle can clear the relieved portion in the locking pin and the lock opened without moving the shackle retainer block or shackle base channel. This is the secondary or by-pass opening system.

An alternative preferred best mode embodiment provides, instead of a gear on the key shaft, an elongated offset flange having a slot for receiving a pin in the trigger plate. Rotation of the key rotates the flange. The pin rides in the slot, rotating the trigger plate and the by-pass lock opening is as before.

THE DRAWINGS

The invention is described in connection with the drawings in which.

DETAILED DESCRIPTION OF THE BEST MODE OF THE INVENTION

The following detailed description illustrates the invention by way of example and not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
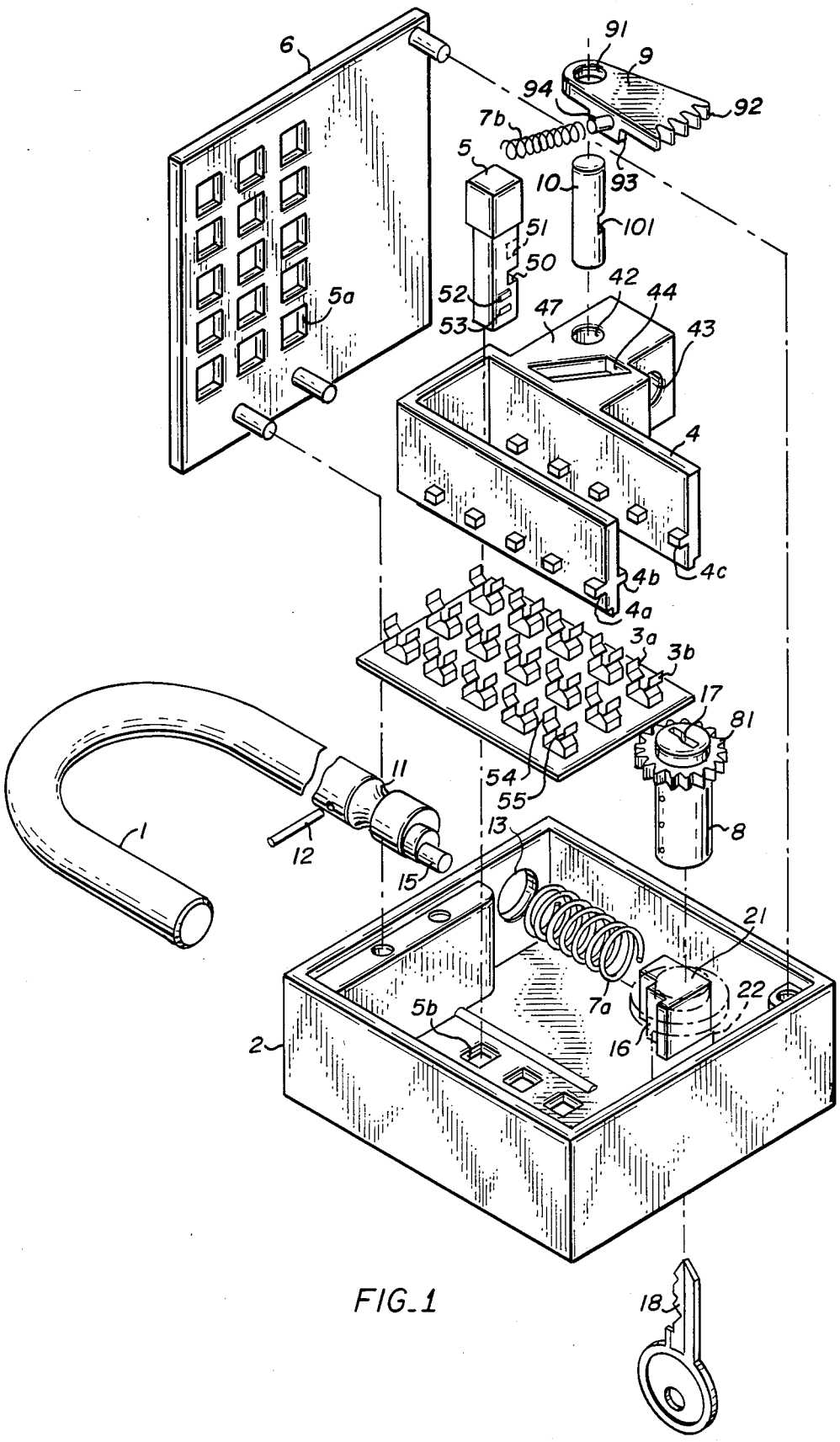
FIG. 1 is an exploded perspective showing the embodiment of the parts and their interrelationship.
Figure 2:
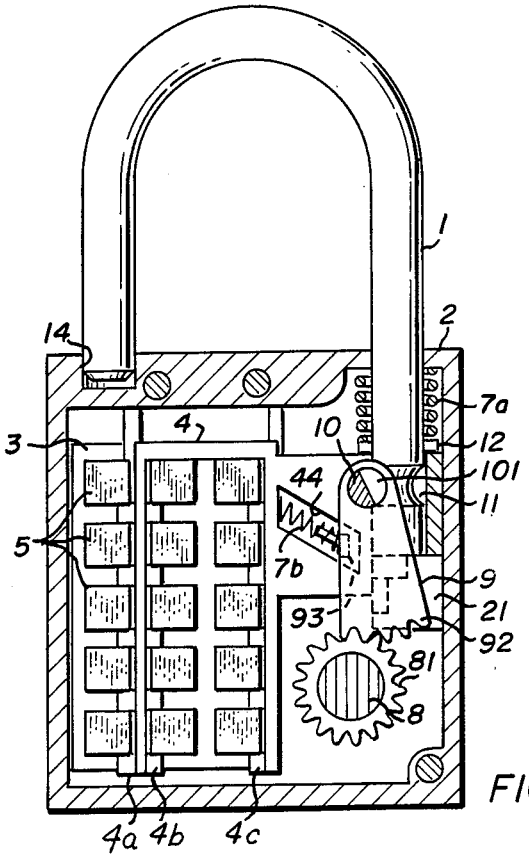
FIG. 2 is a side elevation, partly in cross section showing the secondary key lock assembly in the locked position.

Referring first to FIG. 1, a hardened U-shaped shackle 1 is received in a generally rectangular lock housing 2, one end of the shackle passing through hole 13 and the other end being received in a recess 14 (best seen in FIG. 2). A sheet-type spring 3 is disposed in the housing for the purpose of retaining a plurality of push-buttons 5. The sheet-type button-retaining spring includes a plurality of tabs 3*a*, 3*b*, etc. having V-shaped indentations 54, 55 which alternately engage the recesses 52, 53 in the sides of the buttons 5. The buttons are of sufficient length that in the locked position all the buttons extend through holes 5*a* in the faceplate 6. The lower end of the button (as shown in FIG. 1) is received in hole 5*b* in the back face of the lock. The bottom face of the button is generally co-planar with the outside back face of the lock. When the button is depressed, the opposed tabs 3*a*, 3*b* spring outwardly, and the V-shaped indentations slip out of recess 53 and into recess 52. The lower end of push-button 5 then projects through the hole 5*b* in the lock housing 2.

Figure 4:
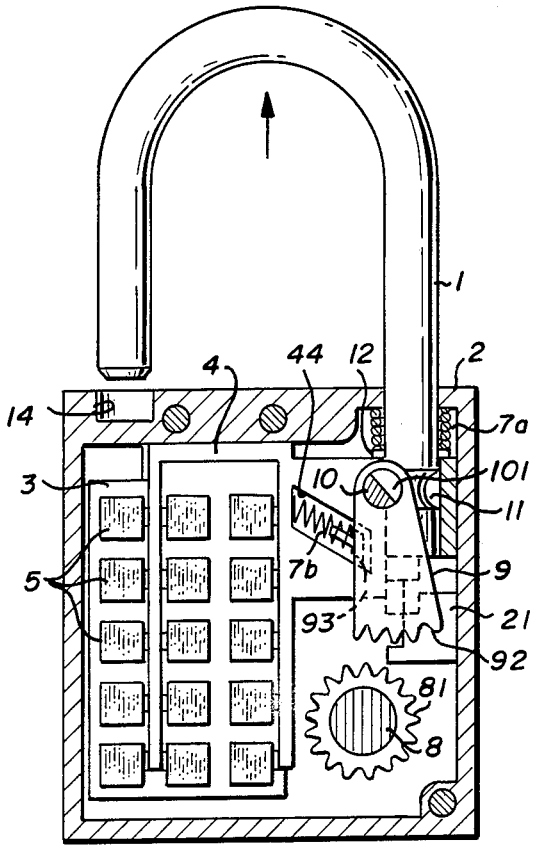
FIG. 4 is a side elevation of the key lock embodiment of FIGS. 1–3 when the primary push button locking system is actuated to the unlock combination position.

The push-button 5 is shown having a lower notch 50 which is aligned with stop tab projections 4*a*, 4*b* or 4*c*, as the case may be, on the side walls of the reciprocable U-channel 4. Other buttons may have an upper notch 51, shown in FIG. 1 in phantom. To unlock the lock, those buttons with the upper notch only are depressed so that the notch 51 becomes aligned with its appropriate stop tab 4*a*, 4*b* or 4*c*. The other buttons are not depressed as the notch 50 is already aligned with their stop tabs 4*a*, 4*b* or 4*c*. When all the notches and projections are aligned, the U-channel can slide upwardly, thus opening the lock. This is best seen by comparing the position of the U-channel 4 in FIG. 2 with that of FIG. 4. FIG. 2 shows the locked position while FIG. 4 shows the unlocked position. The combination is very simply changed by appropriate distribution of the desired number of buttons having the upper notch 51 in the array of buttons shown.

As shown here, 15 buttons are employed. These buttons may be designated with alphabetic symbols or with number symbols. I prefer from 3 to 5 buttons to form the combination, although more or less may be used. While paired, opposed tabs 3*a* and 3*b* are shown for each button, should be understand that a single spring tab may be employed. In addition, the sheet spring 3 may be made in multiple parts. I prefer 15 or more buttons as that provides a sufficient number of combinations without duplication.

To relock the open lock, the shackle is realigned with its recess 14 and the compression-type return spring 7*a* pushes the shackle into the recess and reciprocates the U-channel back to its original position as shown in FIG. 2. The combination buttons projecting through the holes 5*b* in the rear face of the lock are then manually pressed so that their surfaces are flush with the rear face, thus returning the buttons to the original locked, starting position. This also prevents others from determining what the combination is by the positions of the depressed buttons. The return spring 7*a* is compressed between the inner wall of the lock housing 2 and the cross pin 12. This is best seen in FIGS. 2 and 4.

Attached to, and movable with the U-channel 4 is a shackle retainer block 41. Note that the long end of the shackle passes through the hole 13 in the housing and thence through shackle hole 43 in the retainer block. As best seen by comparing FIGS. 2 and 4, a stop block 21 is positioned in the lock housing to provide a positive stop position for the end of the shackle 1 in its locked position. End pin 15 on the shackle matches the notched step 16 in the stop block 21, providing for positive alignment of the shackle before seating. Thus, if the shackle is rotated out of position when the lock is open, the end pin prevents locking of the lock in the open position because it will not mate with step 16.

Figure 3:
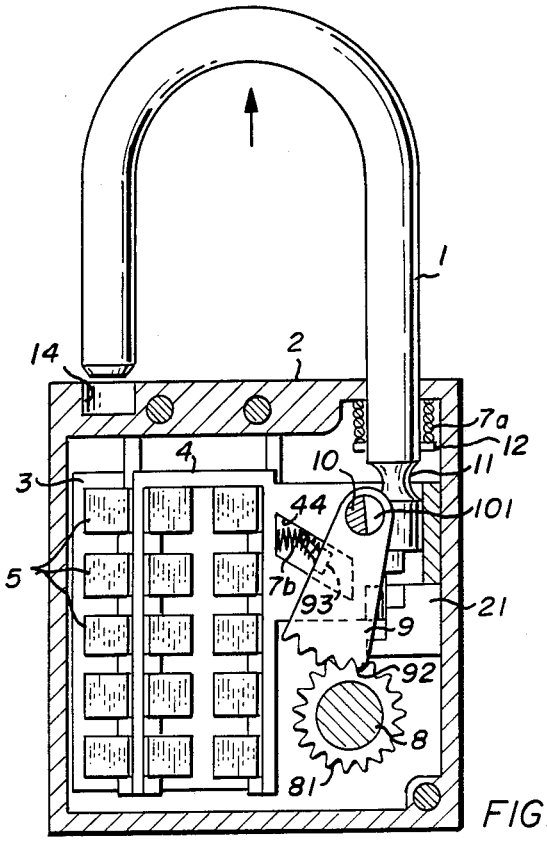
FIG. 3 is a side elevation of the key lock embodiment of FIGS. 1 and 2 in the unlocked position.

The secondary key system for this invention includes a trigger plate 9 to which is attached a secondary locking pin 10. The locking pin 10 is rotatably received in hole 42 in the shackle retainer block 41. In a first embodiment, one end of the trigger plate 9 has a set of teeth 92 which matingly engage a gear 81 disposed adjacent one end of a key cylinder assembly 8. The key cylinder assembly 8 is retained in position by a key cylinder-receiving member 22, shown in phantom in FIG. 1. A key 18 is inserted in the key slot 17 from the backside of the lock (not shown) and the gear 81 turns when the key is rotated. In turn, this rotates the trigger plate 9 as seen by comparing FIGS. 2 and 3. The secondary locking pin 10 is mounted normal to the shackle. The pin 10 has a groove 101 therein which is aligned with a semicircular groove 11 in the shackle 1. As seen in FIG. 3, when the trigger plate 9 is rotated so that the bottom of the groove 101 is generally aligned with the exterior surface of the shackle shaft, the shackle clears the locking pin 10 and can be pulled upwardly against pressure of spring 7*a* so the lock opens. This is best shown in FIG. 3.

In contrast, when the trigger plate is in the unlocked position as shown in FIG. 2, the remaining non-grooved portion of the secondary locking pin 10 prevents clearance of the shackle. The lock cannot be opened unless the proper combination of push buttons is actuated. Note that it is critical that the secondary locking pin 10 be located to mate with the annular groove 11 in the shackle, and so positioned that the center of the secondary locking pin is located at the outer surface of the shackle 1.

A trigger plate return spring *7b* is received in recess 44 in the shackle retainer block 41. The trigger plate 9 also has a stop assembly comprising a flange 93 and pin 94 which receivingly engages the return spring *7b*. As can be seen by comparing FIGS. 2 and 3, when the trigger plate is rotated, the pin and flange assembly abut the upper edge of the recess 44, thus preventing the trigger plate from rotating any further. If the trigger plate were to rotate further then the shackle would again become locked and not openable. Thus, the key cylinder cannot be turned too far, there being a positive stop in the trigger plate assembly. The secondary locking pin is received in the hole 91 in the trigger plate. I prefer the secondary locking pin also to be hardened, and it may be swaged onto the trigger plate 9.

As noted by comparing FIGS. 2 and 4, when the proper combination of push buttons is actuated, the unnotched portion of the secondary locking pin 10 engages the edge of the groove 11 in shackle 1 and the entire trigger plate is carried upwardly when the shackle is opened. The entire U-channel and shackle retainer block slides upwardly as previously described. Upon relocking, the assembly returns to the position shown in FIG. 2.

If the user forgets the push button combination, a key may be inserted in the opening of the key cylinder 8 and rotated. By this rotation of the cylinder and the gear 81, the toothed end of the trigger plate causes the rotation of the secondary locking shaft so that the groove permits clearance of the shackle. By pulling down the lock housing, the lock may be opened because the secondary locking shaft is no longer blocking the movement of the shackle. Once the shackle is released, the spring *7a* automatically returns the shackle 1 back to is original position.

Further, if the user presses the appropriate combination of buttons (see FIG. 4), the lock may also be unlocked by pulling down on the lock housing so that the U-channel and shackle retainer block move. Although the trigger plate 9 is separated from the key cylinder 81, the position of the trigger plate stays the same because the retainer spring *7b* is pushing against the stop flange 93. Therefore, when the shackle 1 is returned to its original position, the teeth 92 on the end of the trigger plate 9 will still be properly aligned with the gear 81.

The stop flange 93 also adds additional strength to the secondary locking shaft. Even if the groove 101 is attempted to be enlarged by a thief pulling repeatedly on the shackle, this would cause the upper lower edge of the stop flange 93 to abut the side walls of the spring recess groove 44 assisting in preventing opening of the lock.

Figure 5:
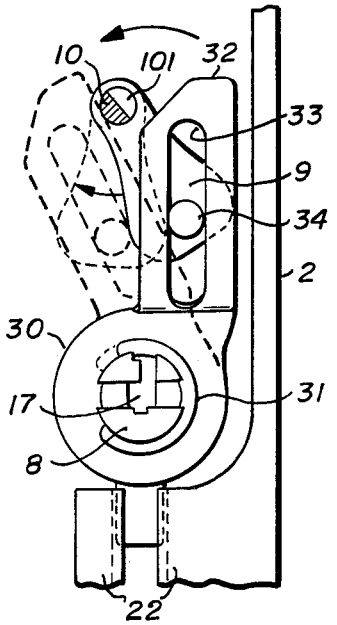
FIG. 5 shows a partial side elevation of a the preferred, best mode embodiment of the key lock actuating mechanism employing an elogated tab with a slot engaging a pin in the rotatable trigger plate.

FIG. 5 shows an alternate preferred best mode embodiment in which a washer 30 having an elongated flange portion 32 is retained adjacent the end of the key cylinder 8 by means of a C-chaped locking clip 31 in the same relative position as the gear 81 shown in FIGS. 1–4. The flange portion 32 contains a guide slot 33. Instead of teeth 92 at the end of the trigger plate 9, the trigger plate 9 in this embodiment has a pin 34 which rides in the slot 33 of the flange portion of the washer assembly 30. The actuation is as before. As the key 18 is inserted in the key slot 17 and turned, the flange 32 is rotated to the left as seen in FIG. 5 to the position shown in phantom. The pin 34 rides downwardly and to the left in the slot 33 to the position shown in phantom. The secondary locking pin 10 is rotated so that the groove 101 permits clearance of the exterior face of the shackle, and the lock can be opened without the combination being pressed.

In addition, in this preferred embodiment, when the key is not employed and the flange is in the position shown in solid lines in FIG. 5, when the push buttons are actuated and the lock opened by means of the combination, the U-channel and shackle retainer block is pulled upwardly. The trigger plate with its pin 34 follows, with the pin 34 riding in slot 33. There can be no misalignment of disengagement of the pin from the slot 33 so that there is no misalignment of the trigger plate. This is the preferred embodiment and best mode of carrying out the invention because it is possible for the gear and toothed trigger plate embodiment assembly to become misaligned in certain circumstances. For example, when the lock is opened by push-buttons, if the key is turned inadvertantly and the lock then closed, the trigger plate could become misaligned even though the teeth 92 mesh with the gear teeth 81. It might be possible, for example for the teeth to become misaligned so that the groove 101 is permanently aligned so that the shackle surface clears the groove. Thus the purpose of the lock would be defeated. While the lock can be realigned by reopening and turning the key back to the proper position, the experienced users may not know this and may inadvertantly render the lock unlockable or unopenable through the misuse of the key system.

In the preferred embodiment, this cannot occur because there is always positive linkage of the pin 34 in the slot 33. The key must be vertically aligned before it can be withdrawn, so that the non-grooved portion of the secondary locking pin 10 always engages the shackle and the shackle is in the locked position.

It should be understood that various modifications within the scope of this invention can be made by one of ordinary skill in the art without departing from the spirit thereof. For example, the pin 34 and slot 33 can be reversed, with a curved slot in the trigger plate 9 and the pin carried on the flange 32. I therefore wish my invention to be defined by the scope of the appended claims as the prior art will permit, and in view of the specification if need be.

I claim:

1. A push-button combination lock having in operative combination:

(a) a housing and a shackle receivingly engageable therewith;

(b) a push-button combination assembly disposed in said housing having means for permitting said shackle to be reciprocably openable upon activation of one or more push-buttons thereof;

(c) a keyed cylinder assembly disposed in said housing; and (d) means for permitting said shackle to be released for opening independent of said push-button assembly by keyed rotation of said cylinder assembly.

2. A push-button combination lock having in operative combination:

(a) a housing and a shackle receivingly engageable therewith;

(b) a push-button combination assembly disposed in said housing having means for permitting said shackle to be reciprocably openable upon activation of one or more push-buttons thereof;

(c) a keyed cylinder assembly disposed in said housing;

(d) means for permitting said shackle to be released for opening independent of said push-button assembly by keyed rotation of said cylinder assembly;

(e) said push-button combination assembly shackle openable means includes:

(i) a reciprocable member having a plurality of projecting tabs in a spaced array, (ii) an array of buttons comprising:

(1) a plurality of buttons of a first configuration, each having a slot therein alignable with a projecting tab to permit said tab to reciprocate without engaging said button when said first button is disposed in a first, raised position, and to block movement of said tab and said reciprocable member when said first button is disposed in a second, depressed position, and (2) at least one button of a second configuration having a slot therein alignable with a projecting tab to permit said tab to reciprocate without engaging said second button when said second button is disposed in a second, depressed position, and to block movement of said tab and said reciprocable member when said second button is disposed in a first, raised position;

(f) a shackle retainer member secured to said reciprocable member; and (g) said shackle, said reciprocable member and said shackle retainer member being reciprocable to an open position when said second configuration buttons in said array are depressed.

3. A push-button combination lock as in claim 2 wherein:

(a) at least 10 buttons are present in said array; and (b) at least two buttons are of said second configuration.

4. A push-button combination lock as in claim 3 wherein:

(a) there are fifteen buttons in said array disposed in three columns of five buttons.

5. A push-button combination lock having in operative combination:

(a) a housing and a shackle receivingly engageable therewith;

(b) a push-button combination assembly disposed in said housing having means for permitting said shackle to be reciprocably openable upon activation of one or more push-buttons thereof;

(c) a keyed cylinder assembly disposed in said housing;

(d) means for permitting said shackle to be released for opening independent of said push-button assembly by keyed rotation of said cylinder assembly;

(e) said push-button combination assembly shackle openable means includes a shackle retaining member secured to said reciprocable member;

(f) a trigger plate member having a locking pin member rotatably mounted in said shackle retaining member;

(g) said keyed cylinder assembly includes a flange which is rotatable upon rotation of said cylinder by turning said key;

(h) said flange having means engaging said trigger plate member to rotate said trigger plate and locking pin upon turning said key; and (i) said locking pin and said shackle being adapted to releasably engage said shackle in a first rotational position of said locking pin and disengage said shackle so said shackle is openable at a second rotational position of said locking pin.

6. A push-button combination lock as in claim 5 wherein:

(a) said shackle is adapted with a semi-circular annular groove adjacent one end, and is reciprocably received in said shackle retaining member;

(b) said locking pin is disposed normal to said shackle in said shackle annular groove in the shackle locked position; and (c) said locking pin is adapted with a groove providing clearance for said shackle when said locking pin is in said second rotational position.

7. A push-button combination lock as in claim 2 wherein:

(a) a trigger plate member having a locking pin member rotatably mounted on said shackle retaining member;

(b) said keyed cylinder assembly includes a flange which is rotatable upon rotation of said cylinder by turning said key;

(c) said flange having means engaging said trigger plate member to rotate said trigger plate and locking pin upon turning said key; and (d) said locking pin and said shackle being adapted to releasably engage said shackle in a first rotational position of said locking pin and disengage said shackle so said shackle is openable at a second rotational position of said locking pin.

8. A push-button combination lock as in claim 7 wherein:

(a) said shackle is adapted with a semi-circular annular groove adjacent one end, and is reciprocably received in said shackle retaining member;

(b) said locking pin is disposed normal to said shackle in said shackle annular groove in the shackle locked position; and (c) said locking pin is adapted with a groove providing clearance for said shackle when said locking pin is in said second rotational position.

9. A push-button combination lock as in claim 1 wherein:

(a) said keyed cylinder is a common cylinder rotatable by a master key.

10. A push-button combination lock as in claim 2 wherein:

(a) said keyed cylinder is a common cylinder rotatable by a master key.

11. A push-button combination lock as in claim 6 wherein:

(a) said keyed cylinder is a commmon cylinder rotatable by a master key.

12. A push-button combination lock as in claim 8 wherein:

(a) said keyed cylinder is a common cylinder rotatable by a master key.

13. A push-button combination lock as in claim 5 wherein:

(a) said trigger plate includes means to prevent overrotation of said locking pin.

14. A push-button combination lock as in claim 7 wherein:

(a) said trigger plate includes means to prevent overrotation of said locking pin.

15. A push-button combination lock having in operative combination:

(a) a housing and a shackle receivingly engageable therewith;

(b) a push-button assembly disposed in said housing having means for permitting said shackle to be reciprocably openable upon activation of one or more push-buttons thereof;

(c) a keyed cylinder assembly disposed in said housing;

(d) means for permitting said shackle to be released for opening independent of said push-button assembly by keyed rotation of said cylinder assembly;

(e) said push-button combination assembly shackle openable means includes a shackle retaining member secured to said reciprocable member;

(f) a trigger plate member having a locking pin member rotatably mounted in said shackle retaining member;

(g) said keyed cylinder includes a gear member which is rotatable upon rotation of said cylinder by turning said key;

(h) said trigger plate having gear teeth along one margin thereof disposed to engage said cylinder gear to rotate said trigger plate and locking pin upon turning said key; and (i) said locking pin and said shackle being adapted to releasably engage said shackle in a first rotational position of said locking pin and disengage said shackle so said shackle is openable at a second rotational position of said locking pin.

16. A push-button combination lock as in claim 2 wherein:

(a) a trigger plate member having a locking pin member rotatably mounted in said shackle retaining member;

(b) said keyed cylinder assembly includes a gear member which is rotatable upon rotation of said cylinder by turning said key;

(c) said trigger plate having gear teeth along one margin thereof disposed to engage said cylinder gear to rotate said trigger plate and locking pin upon turning said key; and (d) said locking pin and said shackle being adapted to releasably engage said shackle in a first rotational position of said locking pin and disengage said shackle so said shackle is openable at a second rotational position of said locking pin.

17. A push-button combination lock as in claim 5 wherein:

(a) said trigger plate engaging means is a slot in said flange, and said trigger plate includes a pin engaging said slot.

18. A push-button combination lock as in claim 7 wherein:

(a) said trigger plate engaging means is a slot in said flange, and said trigger plate includes a pin engaging said slot.

19. A push-button combination lock as in claim 15 wherein:

(a) said keyed cylinder is a common cylinder rotatable by a master key.

20. A push-button combination lock as in claim 18 wherein:

(a) said keyed cylinder is a common cylinder rotatable by a master key.

* * * * *